US006668727B1

(12) United States Patent
Kim et al.

(10) Patent No.: US 6,668,727 B1
(45) Date of Patent: Dec. 30, 2003

(54) EXPLOSIVELY DRIVEN IMPACTOR GRENADE

(75) Inventors: Steven S. Kim, Crofton, MD (US); Christopher G. Melkonian, Alexandria, VA (US); Michael P. Dunnigan, Bowie, MD (US); Carl Gotzmer, Jr., Accokeek, MD (US); Joe Mayersak, Asburn, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/463,936

(22) Filed: Jun. 18, 2003

(51) Int. Cl.[7] ..... F42B 12/10; F42B 27/00

(52) U.S. Cl. ..... 102/482; 102/307; 102/383; 102/476; 102/480; 102/487; 86/50

(58) Field of Search ..... 102/306–310, 102/383, 476, 480, 482, 487, 488, 489; 86/50

(56) References Cited

U.S. PATENT DOCUMENTS 34,302 A * 2/1862 Jones
4,982,668 A 1/1991 Bender et al. ..... 102/495
5,090,324 A * 2/1992 Bocker et al. ..... 102/476
5,191,169 A * 3/1993 Hu ..... 102/476
5,313,890 A 5/1994 Cuadros ..... 102/496
5,866,841 A 2/1999 Green et al. ..... 102/486
H2039 H * 8/2002 Holt et al. ..... 102/307
6,510,797 B1 * 1/2003 Fong ..... 102/476

FOREIGN PATENT DOCUMENTS

FR 2588950 * 4/1987 ..... 102/476

* cited by examiner

*Primary Examiner*—Harold J. Tudor
(74) *Attorney, Agent, or Firm*—Mark Homer

(57) ABSTRACT

An explosively driven impactor grenade includes a grenade body having a substantially spherical shape and a hollow central portion, the grenade body including a plurality of recesses formed on an external surface thereof with each recess including an opening into the hollow central portion of the grenade body, the grenade body including an opening on the exterior surface that connects with the hollow central portion; a fuze disposed in the hollow central portion of the grenade body; a fuze cap for closing the opening on the exterior surface that connects with the hollow central portion; and a plurality of explosively driven impactors respectively disposed in the plurality of recesses formed on the external surface of the grenade body, the explosively driven impactors being connected to the fuze through the recess openings into the hollow central portion of the grenade body.

19 Claims, 2 Drawing Sheets

EXPLOSIVELY DRIVEN IMPACTOR GRENADE

STATEMENT OF GOVERNMENT INTEREST

The invention described herein may be manufactured and used by or for the Government of the United States of America for government purposes without the payment of any royalties therefor.

BACKGROUND OF THE INVENTION

The invention relates in general to grenade type munitions and in particular to a grenade type munition comprising Explosively Driven Impactors (EDIs).

A need exists for a biological and chemical agent defeat warhead. The warhead would enable the attack of chemical and biological agents located within semi-hardened or hardened storage and manufacturing facilities. The warhead would be delivered by a precision air, ship or submarine weapon system, with minimum collateral damage to the surrounding area. To destroy biological and chemical agents, the agents must first be released from their containers. The EDI grenades are designed to rupture containers to release the chemical and/or biological agent contents with minimal collateral damage due to low overpressure from the grenades. Once the agents are released, the Agent Defeat High Temperature Thermal Radiator (HTTR) payload will destroy the agents. The EDI grenade can also be used by individual soldiers as a hand grenade.

The EDI grenades for agent defeat application are thermally fuzed to operate when a pre-determined room temperature is reached. The thermal fuzing is required for agent defeat application because to minimize collateral damage, the room temperature needs to be high enough to create a lethal environment for biological agents before the agent containers are ruptured. The EDI grenades can be alternatively fuzed for other applications such as for anti-personnel. Other fuzing methods for an EDI grenade include time delay, pressure sensing and impact fuzing.

If existing grenades such as the M67, M61 or MK3A2 were used for agent defeat application, the collateral damage would be much higher due to its greater over-pressure characteristic. These hand grenades do not have the penetration capability of an EDI grenade.

The invention will be better understood, and further objects, features, and advantages thereof will become more apparent from the following description of the preferred embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION OF THE PREFERRED EMBODIMENTS

The purpose of the Explosively Driven Impactors (EDI) grenade is to cause damage to equipment, storage containers, and personnel. In one scenario, the EDI grenade ruptures containers filled with biological or chemical agents with minimal collateral damage effects due to its low overall overpressure output. The EDI grenade is unique because of the use of EDIs. This application of EDI technology inflicts multi-directional damage, possesses greater penetration capability than existing hand grenades and eliminates the need for a self-righting mechanism.

The EDI grenade includes a grenade body having a substantially spherical shape. For the purposes of this patent, a substantially spherical shape includes spherical, flattened spherical and geodesic shapes. The importance of the substantially spherical shape of the grenade body is that it allows the EDI grenade to be multi-directional no matter how it finally comes to rest. In this regard, a self-righting mechanism is not required. For example, in agent defeat applications, the EDI grenade can affect storage containers regardless if it lands next to or on top of a container and regardless of its landing orientation. The grenade body material may be metallic (steel, aluminum, etc.) or plastic. The diameter of the grenade body may vary from, for example, two inches to thirty-six inches.

Figure 1:
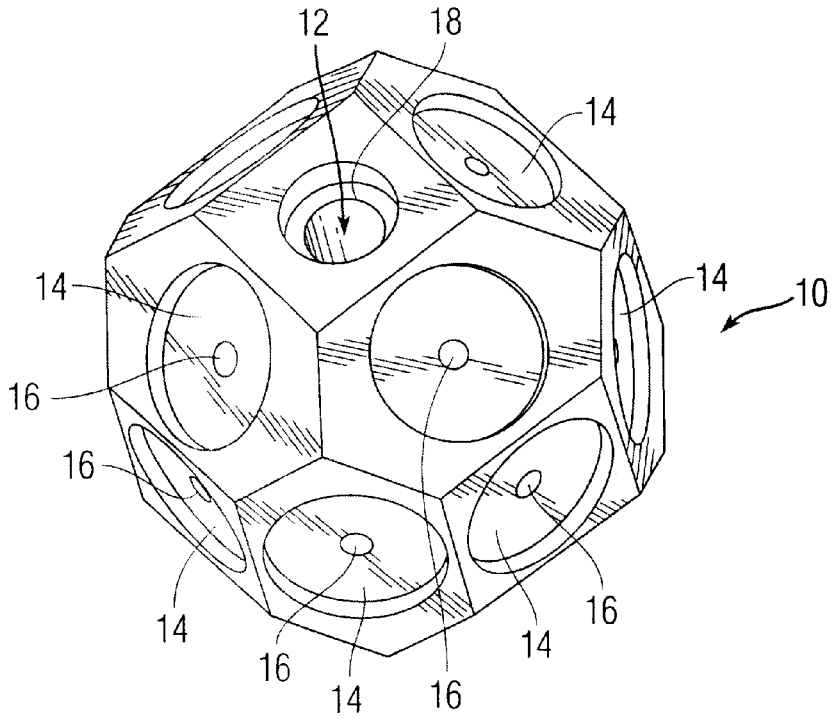
FIG. 1 is a perspective view of a one embodiment of a grenade body.

FIG. 1 is a perspective view of a one embodiment of a grenade body 10. Grenade body 10 has a geodesic shape. Grenade body 10 includes a hollow central portion 12 for receiving a fuze. The exterior surface of the body 10 includes a plurality of recesses 14 formed thereon for receiving the EDIs. Each recess 14 includes an opening 16 into the hollow central portion 12 of the grenade body 10 to allow deflagration cord to connect the EDIs with the fuze. The grenade body 10 also includes an opening 18 on the exterior surface for insertion of the fuze. The opening 18 connects with the hollow central portion 12

Figure 2:
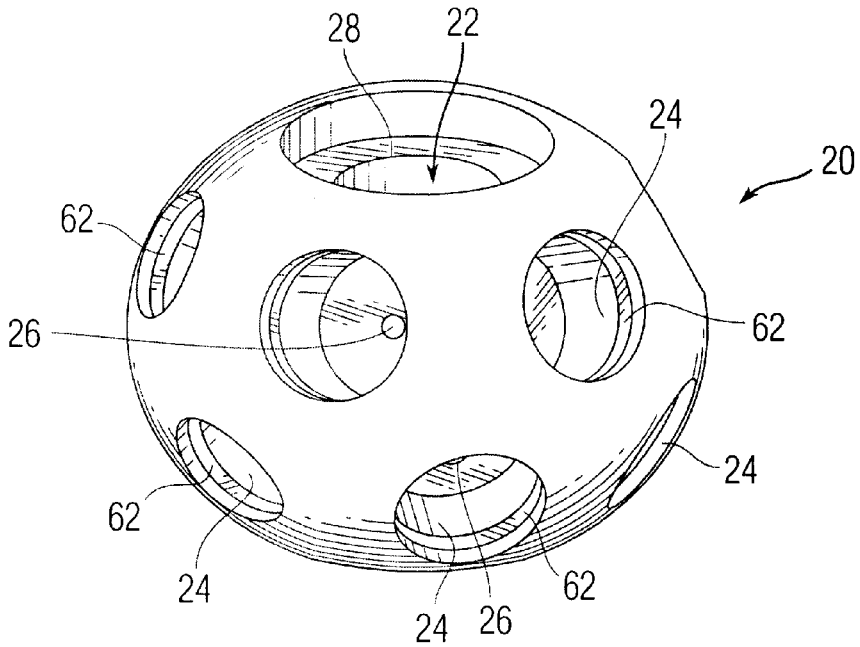
FIG. 2 is a perspective view of a second embodiment of a grenade body.

FIG. 2 is a perspective view of a second embodiment of a grenade body 20. Grenade body 20 has a flattened spherical shape. Grenade body 20 includes a hollow central portion 22 for receiving a fuze. The exterior surface of the body 20 includes a plurality of recesses 24 formed thereon for receiving the EDIs. Each recess 24 includes an opening 26 into the hollow central portion 22 of the grenade body 20 to allow deflagration cord to connect the EDIs with the fuze. The grenade body 20 also includes an opening 28 on the exterior surface for insertion of the fuze. The opening 28 connects with the hollow central portion 22.

Figure 3A:
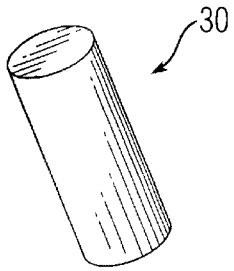
FIG. 3A schematically shows a fuze and FIG. 3B shows a fuze cap.
Figure 3B:
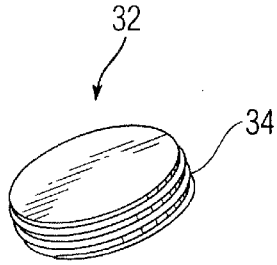

FIG. 3A schematically shows a fuze 30. Fuze 30 is disposed in the hollow central portion 12 of the grenade body 10 or the hollow central portion 22 of the grenade body 20. The EDI grenade contains a single fuze 30. Fuzing methods include thermal, time delay, pressure sensing and impact, depending upon the application. The EDIs (FIG. 4) are all connected to this common fuze 30 so that the EDIs will all initiate at the same time. FIG. 3B shows a fuze cap 32 for closing the openings 18, 28 on the exterior surface that connects with the hollow central portions 12, 22. The fuze cap 32 may include threads 34 that mate with threads on the interior of openings 18, 28.

Figure 4:
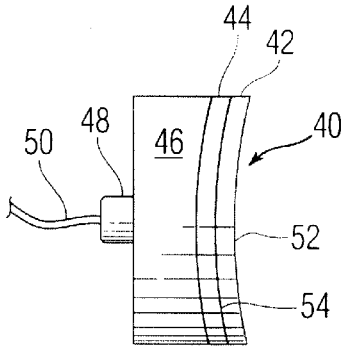
FIG. 4 is a side view of an explosively driven impactor.

FIG. 4 is a side view of an explosively driven impactor (EDI) 40. EDI 40 includes a circular metal disk 42, a backing layer 44, high explosive 46, an ignition device 48 and deflagration cord 50. The EDI 40 fits in the recesses 14, 24 in the grenade bodies 10, 20 with the circular metal disk 42 facing outward. The deflagration cord 50 is fed through the openings 16, 26 in the recesses 14, 24. All the cords 50 are joined together and then attached to fuze 30 so that all the EDIs will actuate at the same time.

Circular metal plate 42 is preferably concave on its side 52, that is, the side that faces away from the grenade body. The internal side of plate 42 is preferably convex. A preferred metal for plate 42 is copper. The thickness of plate 42 is, for example, from about 0.07 inches to about 0.125 inches. The plate thickness depends on the plate diameter and the target thickness desired to be penetrated. The plate 42 is pressed formed into its curved shape. Copper is easily formed into different shapes. The recesses 14, 24 are deep enough so that the EDIs 40 do not extend further outward than the adjacent exterior surface of the body 10, 20.

Figure 5A:
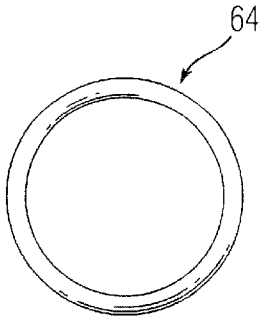
FIG. 5A shows a gasket.
Figure 5:
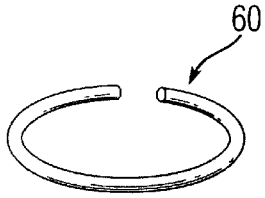
FIG. 5 shows a retaining ring.

Behind plate 42 is a backing layer 44 comprising an elastomer such as solid rubber (i.e., not foam rubber). The backing layer 44 is attached to plate 42 with adhesive. The high explosive 46 may be molded into shape or pressed into recesses 14, 24. If the explosive 46 is molded, it is adhered into the recesses 14, 24 with an adhesive compatible with the explosive 46. The explosive 46 is preferably a Class 1.1 High explosive such as C4 or HMX. The plates 42 with backing layer 44 attached are dropped into the recesses 14, 24 on top of the explosive 46. Plate 42 is secured with a retaining ring 60 (See FIG. 5). There is a groove 62 along the circumference of each recess 24 (See FIG. 2) to accept the retaining ring 60. The backing layer 44 is slightly compressed during the retaining ring installation to take up any volume between the backing layer 44 and the explosive 46.

Prior to installing the explosive 46 and plate 42, an ignition device 48 is installed into each recess 14, 24. The ignition device 48 has a small amount of energetic material, such as Boron Potassium Nitrate, in a metallic housing to initiate the explosive 46. Deflagration cords 50 are attached to each ignition device 48. After the ignition devices 48 are all installed and the deflagrating cords 50 are fed out of each recess 14, 24 and into the fuze hole 12, 22, the explosives 46 and plates 42 are installed. After the explosives and plates are installed the deflagrating cords 50 are connected together and joined to a single fuze 30. The fuze is then installed into by way of opening 18, 28 into the hollow central portion or fuze hole 12, 22. A fuze cap 32 is preferably threaded to cover the opening 18, 28. If a time delay fuze is used (such as those used in hand grenades) there will be a pull pin through the cap 32. When the pull pin is pulled, the fuze is activated.

The metal plates 42 undergo a controlled acceleration when the explosive 46 is initiated. The EDI performance characteristics are tailored to meet the required flight distance and target strength. The EDIs 40 are substantially evenly patterned on the grenade body surface. The EDIs 40 are simultaneously initiated when the fuze 30 senses a specific environmental temperature (if the fuze is a thermal fuze). In the agent defeat application, the EDIs are initiated by a thermal fuze when the HTTR reaction drives the temperature in the target area to 250–500° F. Dependent upon the target penetration requirement, the weight ratio of plate 42 to high explosive 46 can be less or greater than one to two.

The grenade disperses the EDIs 40 in multiple directions at a variety of target configurations and at a large velocity range. During dispersal, the grenade can interact with a variety of stationary objects. The body structure is designed to withstand high acceleration loads and high velocity impacts. The orientation of the grenade can vary depending on launch/dispersal velocities and impact angles. Therefore, the grenade body contour is designed with a self-righting shape. At rest, the grenade will position itself in a predefined orientation. This orientation will aim a predefined number of EDIs 40 in a repeatable direction with respect to the ground surface.

Upon detonation, the plates 42 are dispersed at velocities great enough to create holes in metal targets such as steel containers. The penetration ability of even a small EDI is substantial. For example, a 2-inch diameter EDI can create a hole in 1-inch thick armor plate. The size of the EDI grenade will depend upon the size of the EDI utilized. The EDIs employed in the grenade have greater penetration capability against armored targets than existing hand thrown grenades such as the anti-personnel M67 and M61 hand grenades. Depending upon the size of the individual EDI, the EDI can penetrate several inches of metal armor.

Some advantages of the EDI grenade include:

1) Incorporating a number of EDIs into a single grenade to effect a much greater level of damage against equipment and personnel than a single EDI.
2) Minimal collateral damage effects to the surrounding area due to the low-overpressure characteristic of the EDI grenade. For example, if the target were a container filled with weaponized Anthrax spores, the lower-overpressure generated by the EDI grenade would minimize dispersal of the Anthrax spores. This is due to the smaller amount of high explosives required for the EDI operation than that required for hand grenades of comparable size.
3) The EDI grenade is multi-directional. A self-righting mechanism is not required. For example, in agent defeat applications, the EDI grenade can affect storage containers regardless if it lands next to or on top of a container and regardless of its landing orientation.

Figure 4A:
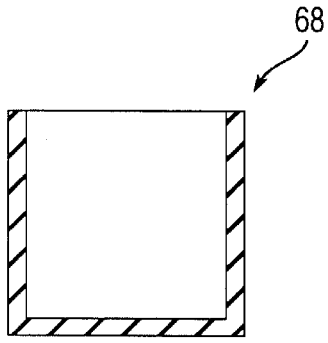
FIG. 4A is a sectional view of a cup for housing an explosively driven impactor.

In an alternative embodiment of the invention, each explosively driven impactor comprises a metal plate 42, a backing layer 44 and an explosive 46. The explosive 46, backing layer 44 and metal plate 42 are contained in a metal housing 68 in the shape of a cup (FIG. 4A). The metal housing 68 is open at the top so that the metal plate 42 is free to launch. The metal housing 68 is made of, for example, aluminum having a thickness of about 0.02 inches. The ignition devices 48 are not used in this embodiment.

The explosive 46, backing layer 44 and metal plate 42 are placed in housings 68. Housings 68 are then placed in recesses 14, 24. An elastomeric gasket 64 (FIG. 5A) is placed atop the housing 62. The retaining ring 60 is then placed in groove 62. The elastomeric gasket 64 between the top of housing 68 and retaining ring 60 takes up any assembly gaps and compensates for thermal dimensional changes.

Figure 6:
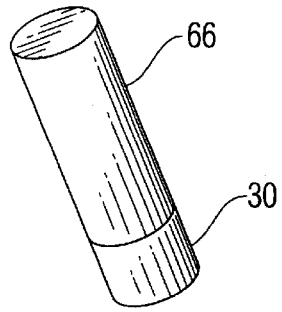
FIG. 6 schematically shows a fuze and a booster charge.

In this alternative embodiment, a booster charge 66 (FIG. 6) is placed in the hollow central portions 12, 22 of the body 10, 20, along with fuze 30. Fuze 30 initiates booster charge 66 which initiates the explosive 46 in the individual EDIs. A physical connection (deflagration cord) between the booster charge 66 and the explosive 46 is not needed, but may be used if desired. The booster charge 66 is near enough to explosive 46 to initiate explosive 46 without deflagration cord. Booster charge 66 comprises, for example, a high explosive.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. An EDI grenade, comprising:

a grenade body having a substantially spherical shape and a hollow central portion, the grenade body including a plurality of recesses formed on an external surface thereof with each recess including an opening into the hollow central portion of the grenade body, the grenade body including an opening on the exterior surface that connects with the hollow central portion;

a fuze disposed in the hollow central portion of the grenade body;

a fuze cap for closing the opening on the exterior surface that connects with the hollow central portion; and a plurality of explosively driven impactors, each explosively driven impactor comprises a circular metal plate, a backing layer, an explosive, an ignition device and a cord, the cord being connected to the fuze, respectively disposed in the plurality of recesses formed on the external surface of the grenade body, the explosively driven impactors being connected to the fuze through the recess openings into the hollow central portion of the grenade body.

2. The EDI grenade of claim 1 wherein the plurality of recesses formed on the external surface of the grenade body are substantially evenly distributed over the external surface of the grenade body.

3. The EDI grenade of claim 1 wherein the grenade body comprises one of metal and plastic.

4. The EDI grenade of claim 1 wherein the fuze is one of thermal, time delay, pressure sensing and impact.

5. The EDI grenade of claim 4 wherein the fuze is thermal and is activated in the range of 250 to 500 degrees Fahrenheit.

6. The EDI grenade of claim 1 wherein the shape of the grenade body is geodesic.

7. The EDI grenade of claim 1 wherein the shape of the grenade body is flattened spherical.

8. The EDI grenade of claim 1 wherein a diameter of the grenade body ranges from about two inches to about thirty-six inches.

9. The EDI grenade of claim 1 wherein said cords comprise deflagration cords.

10. The EDI grenade of claim 9 wherein the circular metal plate comprises copper.

11. The EDI grenade of claim 9 wherein the circular metal plate comprises a concave external surface and a convex internal surface.

12. The EDI grenade of claim 9 wherein the backing layer comprises an elastomer.

13. The EDI grenade of claim 12 wherein the elastomer comprises hard rubber.

14. The EDI grenade of claim 9 wherein a thickness of the circular metal plate is in the range of about 0.07 inches to about 0.125 inches.

15. The EDI grenade of claim 9 wherein the explosive is c4 or HMX.

16. The EDI grenade of claim 1 wherein each recess includes a circumferential groove formed therein, the EDI grenade further comprising retaining rings disposed in the circumferential grooves atop each EDI.

17. An EDI grenade, comprising:

a grenade body having a substantially spherical shape and a hollow central portion, the grenade body including a plurality of recesses formed on an external surface thereof with each recess including an opening into the hollow central portion of the grenade body, the grenade body including an opening on the exterior surface that connects with the hollow central portion;

a fuze and a booster charge disposed in the hollow central portion of the grenade body;

a fuze cap for closing the opening on the exterior surface that connects with the hollow central portion; and a plurality of explosively driven impactors, each explosively driven impactor comprises a circular metal plate, a backing layer, an explosive and a cup-shaped metal housing containing the circular metal plate, backing layer and explosive, respectively disposed in the plurality of recesses formed on the external surface of the grenade body; wherein the fuze initiates the booster charge which initiates the explosively driven impactors.

18. The EDI grenade of claim 17 wherein each recess includes a circumferential groove formed therein, the EDI grenade further comprising an elastomeric gasket placed atop each explosively driven impactor and a retaining ring disposed in the circumferential groove atop each elastomeric gasket.

19. The EDI grenade of claim 17 wherein the plurality of recesses formed on the external surface of the grenade body are substantially evenly distributed over the external surface of the grenade body.

* * * * *